United States Patent [19]

Mathews et al.

[11] Patent Number: 5,035,637

[45] Date of Patent: Jul. 30, 1991

[54] ENGINE VALVE COVER GASKET WITH ELECTRICAL BRIDGE

[75] Inventors: Will W. Mathews, Glen Ellyn; John A. Serio, Addison; James J. Grinsteiner, Roselle, all of Ill.

[73] Assignee: Navistar International Transportation Corp., Chicago, Ill.

[21] Appl. No.: 518,884

[22] Filed: May 4, 1990

[51] Int. Cl.[5] ..... H01R 13/533

[52] U.S. Cl. ..... 439/271; 123/90.38; 277/901; 439/130

[58] Field of Search ..... 439/130, 271; 123/90.38; 277/901

[56] References Cited

FOREIGN PATENT DOCUMENTS 1117124 5/1956 France ..... 277/901

OTHER PUBLICATIONS

"Conductive Adhesives Do Double Duty" *Design News*, 4-23-90.

*Primary Examiner*—Eugene E. Desmond

*Attorney, Agent, or Firm*—Dennis K. Sullivan

[57] ABSTRACT

A plastic gasket assembly of substantially increased thickness, compared to present day elastomeric or composition gaskets, for use in sealing an engine valve cover to a cylinder head thereof, the gasket including a portion incorporating an electrical conductor for creating an electrical bridge through the sealing area between the cylinder head and valve cover by means of which exterior control circuitry can be electrically coupled to electrical or electronic devices disposed internally of the valve cover. In a first embodiment, the wires connecting the devices to the control unit are simply molded into the gasket whereas in a second embodiment, the gasket is drilled or molded to provide holes for inserting the wires, sealing of the wires being accomplished by clamping of the gasket and/or sealant disposed on the wire. In another embodiment, a plastic carrier is provided having transversely extending spacing ribs in which the wires may be laid and covered with a room temperature vulcanizing compound as a sealant.

In still further embodiments, electrically connected integral male cable connectors are formed on the exterior edges of the gasket, and the interior edge in some cases, to permit quick detachment of the control circuitry therefrom to permit removal of the valve cover for servicing the engine while yet another and preferred embodiment provides the lower surface of the gasket with a slot which properly positions the connector on the top edge of the head during assembly and prevents the connector portion of the gasket from being inadvertently pulled out from between the valve cover and cylinder head.

27 Claims, 4 Drawing Sheets

ENGINE VALVE COVER GASKET WITH ELECTRICAL BRIDGE

BACKGROUND OF THE INVENTION

The present invention relates to a gasket assembly incorporating structure which provides an electrical bridge or feedthrough through which electrical signals may be passed and, more specifically, to a gasket assembly of the type used to seal the oily environment within a valve cover on an engine cylinder head comprising a nonconductive gasket integrally incorporating an electrical conductor by means of which engine control circuitry, which is disposed externally of the valve cover, can be electrically coupled to devices, such as fuel injectors and glow plugs disposed within the valve cover without jeopardizing the integrity of the seal or the continuity and insulation of the electrical circuits.

THE PRIOR ART

Heretofore, electrical communication between devices, such as electrically controlled fuel injectors or glow plugs, disposed within an engine valve cover and their externally located control circuitry has been provided by creating holes in the valve cover to pass the wires therethrough and the provision of complex sealing components disposed about the holes to provide an oil tight seal thereat as shown, for example, in FIG. 1. In this regard, the engine art has progressed, primarily due to environmental considerations, from a time wherein a simple grommet might have been used to seal a single wire to substantially more complicated structures to maintain enhanced sealing integrity of multiple circuits. In additions to their cost, these structures result not only in a more costly, time consuming assembly process but may also increase the difficulty of accessing the interior of the valve cover for maintenance and repair.

SUMMARY OF THE INVENTION

Accordingly, it is a primary object of the invention described and claimed herein to provide an engine valve cover gasket with an inexpensive and easily assembled electrical bridge to carry signals from outside the valve cover to circuit components, such as electrically controlled fuel injectors and glow plugs, located within the valve cover.

According to the invention, there is provided a plastic gasket assembly of substantially increased thickness, compared to present day elastomeric or metal composite gaskets, for use in sealing an engine valve cover to a cylinder head thereof, the gasket including a portion incorporating an electrical conductor for creating an electrical bridge through the sealing area between the cylinder head and valve cover by means of which exterior control circuitry can be electrically coupled to electrical or electronic devices disposed internally of the valve cover. In a first embodiment, the wires connecting the devices to the control unit are simply molded into the gasket whereas in a second embodiment, the gasket is drilled or molded to provide holes for inserting the wires, sealing of the wires being accomplished by clamping of the gasket and/or sealant disposed on the wire. In another embodiment, a plastic carrier is provided having transversely extending spacing ribs in which the wires may be laid and covered with a room temperature vulcanizing compound as a sealant.

In still further embodiments, electrically connected integral male cable connectors are formed on the exterior edges of the gasket, and the interior edge in some cases, to permit quick detachment of the control circuitry therefrom to permit removal of the valve cover for servicing the engine while yet another and preferred embodiment provides the connector body portion of the gasket with a slot which properly positions the connector on the top edge of the head during assembly and prevents the connector portion of the gasket from being inadvertently pulled out from between the valve cover and cylinder head, thereby preventing a possible leakage source during subsequent operation of the engine.

BRIEF DESCRIPTION OF THE DRAWINGS

Other objects and advantages of the invention will become more apparent upon reading the detailed description thereof and upon reference to the drawings in which.

DETAILED DESCRIPTION OF THE INVENTION

Figure 1:
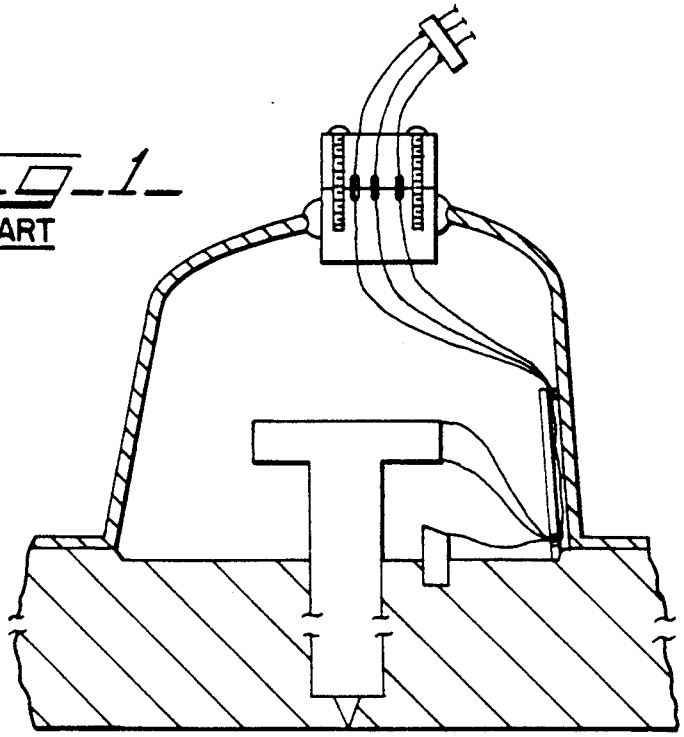
FIG. 1 PRIOR ART
FIG. 1 is a diagrammatic cross-section of an engine cylinder head and valve cover assembly illustrating a prior art electrical connector system used to electrically couple devices within the valve cover to control circuitry located outside of the valve cover.

Referring now to the drawings in greater detail, there is illustrated in FIG. 1 a typical prior art system for making connections to an electrically controlled fuel injector and a glow plug disposed within an engine valve cover to emphasize what can easily be accomplished by the provision of the gasket assembly of the present invention. As illustrated, with the engine shown being a diesel engine, a valve cover gasket that is presently used consists of a thin piece of rubber stock which is blanked to have the appropriate configuration and, as such, is incapable of including any type of electrical bridge therein due to the gasket being too thin. Even if formed of other nonconductive gasket materials, such as cork, the gasket would not have sufficient thickness to permit electrical conductors to be incorporated therein.

In previous designs, electrical communication to devices under the valve cover has been accomplished either by going through the valve cover, as shown, or perhaps through a portion of the cylinder head. In the design of FIG. 1, it has been necessary, in order to provide adequate sealing and permit breaking the circuit when 1 removing the valve cover for service, to provide two mating electrical connectors with mating seals to pass circuitry from outside of the valve cover into the lube oil environment under the valve cover to provide electrical communication with glow plugs and injectors within the valve cover. The electrical connectors necessitate the provision of mating gaskets and screws which may create oil leak paths and complicate the assembly process. Several molded plastic wire guides have been provided within the valve cover to route the circuit wires around the valve train parts to the cylinder head face for unobstructed routing to the injectors and glow plugs. Typically, three circuit wires per cylinder are needed, two of which communicate with the injector and one of which communicates with the glow plug of the diesel engine. Since the circuit wiring within the valve cover travels a circuitous path in order to avoid the valve train, a significant amount of wire is required, all of which must be coated with a coating, such as polytetraflouroethylene (PTFE) or Teflon ® that will tolerate the oil environment, increasing the cost of the system significantly.

Figure 2:
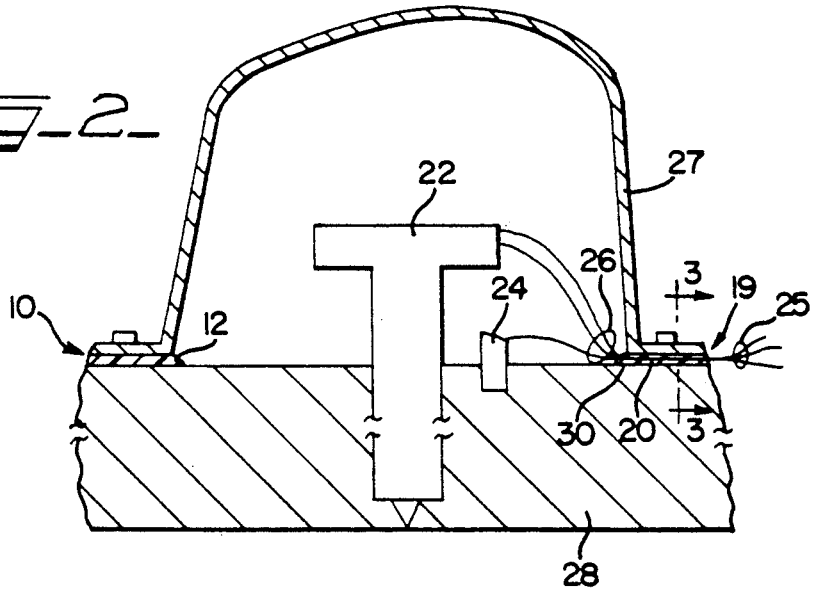
FIG. 2 is a diagrammatic cross-section of an engine cylinder head and valve cover assembly illustrating a first embodiment of the valve cover gasket assembly of the present invention.

Turning now to FIG. 2, it will be seen that a first of the gasket assembly 10 includes a gasket body 12 which has a substantially increased thickness relative to the thickness of ordinary gaskets. The gasket assembly 10 is molded from a nonconductive plastic material, such as glass filled nylon. The plastic gasket assembly 10, most notably, will eliminate the need to use the complex structures described above to bring the electrical circuitry into the oil environment within the valve cover.

In this respect, inasmuch as the gasket body 12 of the gasket assembly 10 shown is molded from a plastic, electrical bridges 19, comprising one or several electrical wires or conductors 20, may be integrally molded within the thickness of the molded gasket body 12. Such an electrical bridge 19, could be placed at any location along the gasket body 12 which would be compatible with the location of a fuel injector 22 and glow plug 24 to be electrically controlled or operated. This simple design of the gasket assembly 10 provides cost saving features over the prior art systems including a decrease in the amount of wiring to be utilized, with the amount of wiring within the valve cover to be insulated from the oil also being decreased. Further, the need for connectors, support structures, and seals, such as described above, is eliminated.

As will be defined in greater detail hereinafter, the various embodiments set forth below for the gasket assembly 10 provide an inexpensive means of creating an electrical bridge 19 comprising the electrical conductors 20 extending transversely across the gasket body 12 to carry electrical impulses from control circuitry wiring 25 on the outside of a valve cover 27 through the molded plastic gasket assembly 10 to electrical component wiring 26 engaged to the injector 22 and glow plug 24 secured to a cylinder head 28, within the valve cover 27.

In FIG. 2, one such bridge 19 is shown to be provided in the form of an insulated wire 30 which is simply molded within the gasket body 12. Alternatively, an insulated wire 30 with the insulation stripped therefrom in the area where the wire crosses through the molded gasket 12 may be provided to provide better bonding of the wires to the gasket material.

Figure 3:
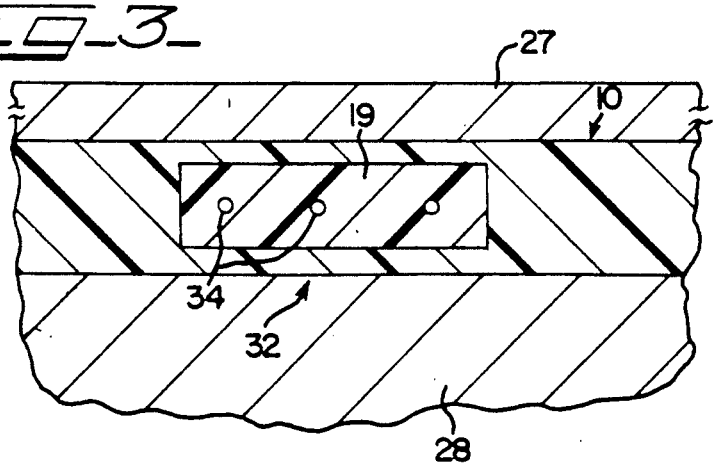
FIG. 3 is an enlarged cross-section of a portion of the gasket assembly of FIG. 2, taken along the line 3—3 thereof, but illustrating a second embodiment of the gasket assembly.

In FIG. 3, which is an enlarged section of an area 32 of the gasket assembly 10 incorporating the electrical bridge 19, yet another alternative is proposed, wherein openings 34 may be drilled through the area 32 of the gasket body 12 following molding of the gasket body 12. Alternatively, the openings 34 may be molded in the gasket body. Wiring (not shown) may be fed through such openings 34 from one side of the gasket body 12 to the other with sealing being provided by the clamping of the gasket 12 against the wiring and preferably also by a sealant being applied to the appropriate section of the wiring prior to insertion in the gasket.

Figure 4:
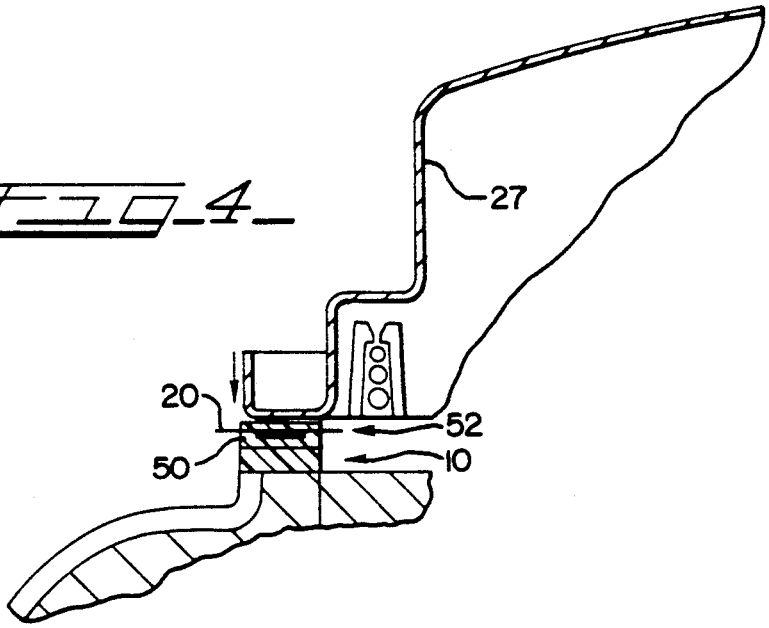
FIG. 4 is a cross-section of an engine cylinder head and valve cover assembly illustrating a third embodiment of the gasket assembly of the present invention.
Figure 5:
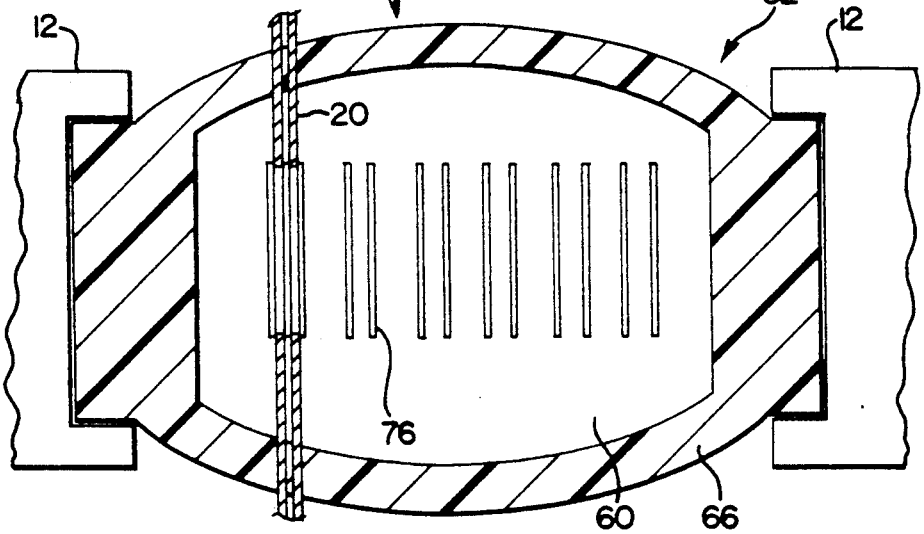
FIG. 5 is a cross-section through a portion of the gasket assembly of FIG. 4.

In the embodiment of FIGS. 4 and 5, electrical conductors 20 are incorporated in the gasket assembly 10 by the provision of an elastomerically sealed element 50 molded to provide a plastic carrier 52, which may be a separate member mechanically interlocked with the rest of the gasket body or molded with the gasket body, having a molded pocket 60 formed therewithin by a peripheral grommet 66. The gasket carrier 52 includes guide ribs 76 as spacing elements for the conductors 20 crossing therethrough within the molded pocket 60. After the conductors have been placed between the guide ribs 76, an oil resistant two-part, fast, room-temperature vulcanizing (RTV) elastomeric compound, which does not require conventional hot molding operations, may be used to fill the pocket 60 and form a seal around the conductors 20. Thus, repair of the grommet 66, if required, can be done with a material found at most automotive and hardware stores, decreasing the field repair time for repairing same.

Figure 6:
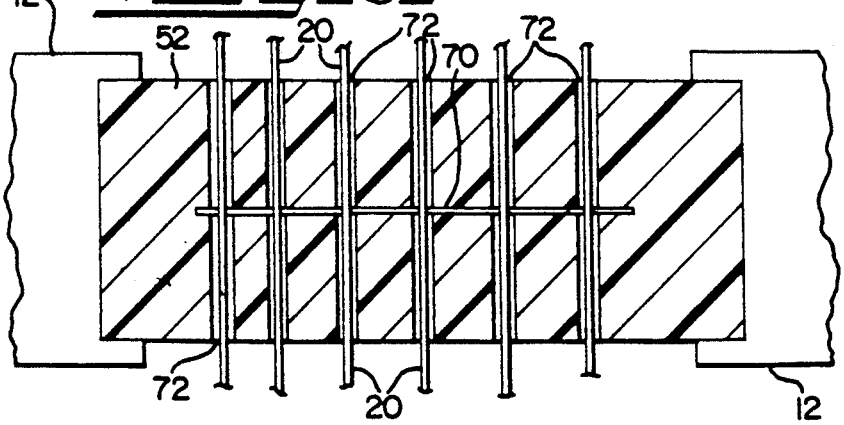
FIG. 6 is a cross-section similar to FIG. 5 but illustrating another embodiment of the gasket assembly.

As shown in FIG. 6, a variation of the plastic carrier 52 incorporates a thin penetrable elastomeric membrane 70 molded in a vertical plane in the center of the carrier perpendicular to the conductors 20, suitable apertures 72 being molded in the carrier body 52 to provided passages to the membrane.

Figure 7:
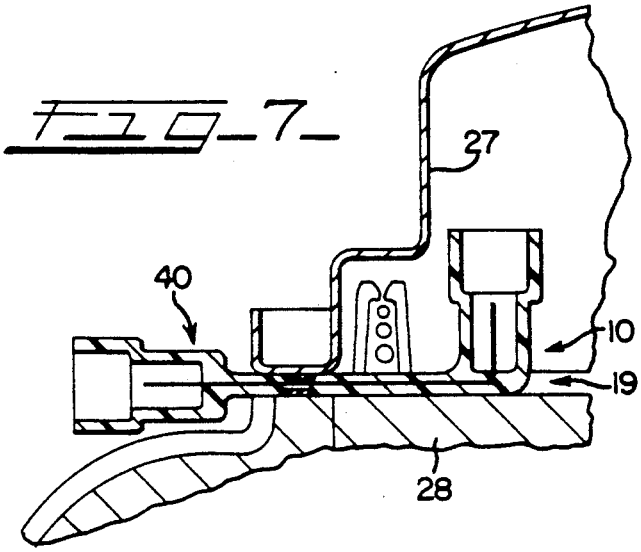
FIGS. 7 and 8 are cross-sections similar to FIG. 4 but illustrating further embodiments of the gasket assembly of the present invention.
Figure 8:
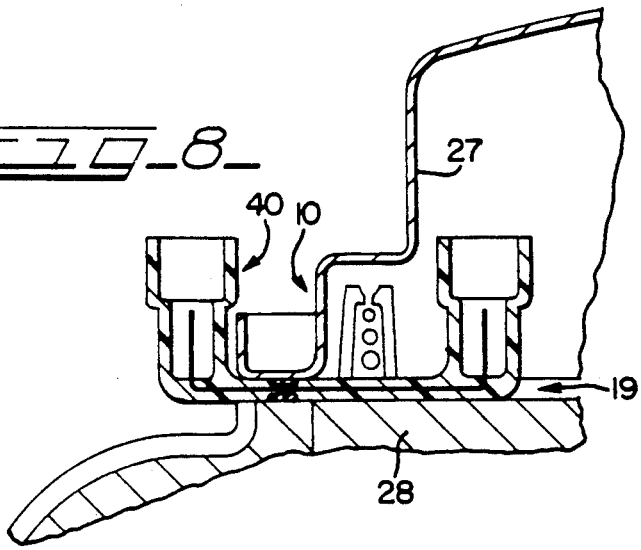

In the embodiments of FIGS. 7 and 8, the ends of bridge 19 are in the form of molded male cable connectors 40 of the multiple pin socket type integrally formed with the gasket assembly 10 at each end of the conductor 20. Alternate, but not exclusive, conformations for the body of electrical bridge 19 are illustrated, the bridge 19 in FIG. 7 being shown to be L-shaped and in FIG. 8 to be U-shaped.

In forming such a gasket assembly 10 with one or more electrical bridges 19, the predominant concern is to provide the conductors 20 within the material of the gasket body 12 in a manner wherein the wiring 25 or 26 is not capable of being pulled from either direction to cause disconnection between the wiring and the conductors 20 within the gasket body 12, or to cause breakage or shorting of the conductors 20 within the material of the gasket body 12. Another requirement is that the gasket body 12 forms an insulation layer to keep the conductors 20 from touching the metal of the valve cover and cylinder head 28. Yet another concern is that, in order to maintain sealing integrity between the valve cover and cylinder head to prevent leakage, the gasket 10, with its bridge 19 coupled at least to the circuitry 26 within the valve cover, must remain in its proper position on the cylinder head 28 during assembly of the valve cover thereon and must stay in position thereafter despite any pulling on the external wiring 25 connected thereto.

Figure 9:
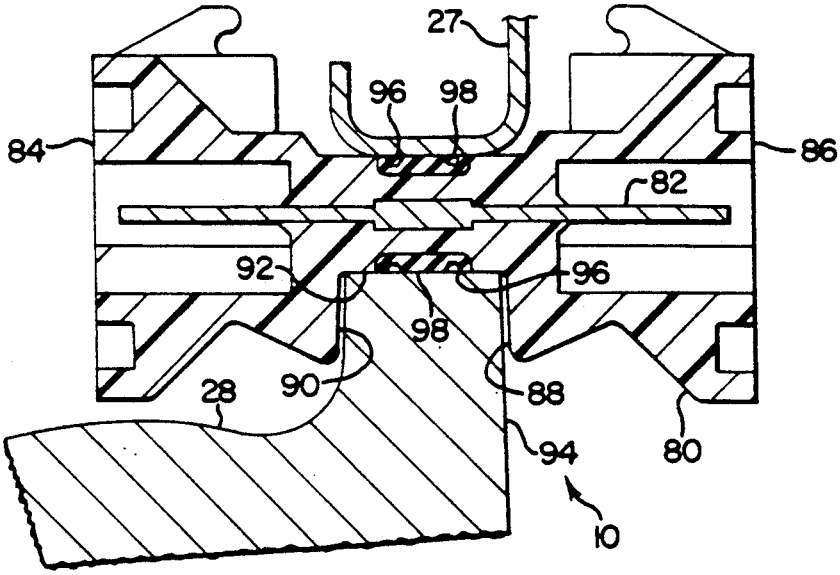
FIG. 9 is an enlarged cross-section similar to FIG. 4 but illustrating a preferred embodiment of the valve cover gasket assembly of the present invention.
Figure 10:
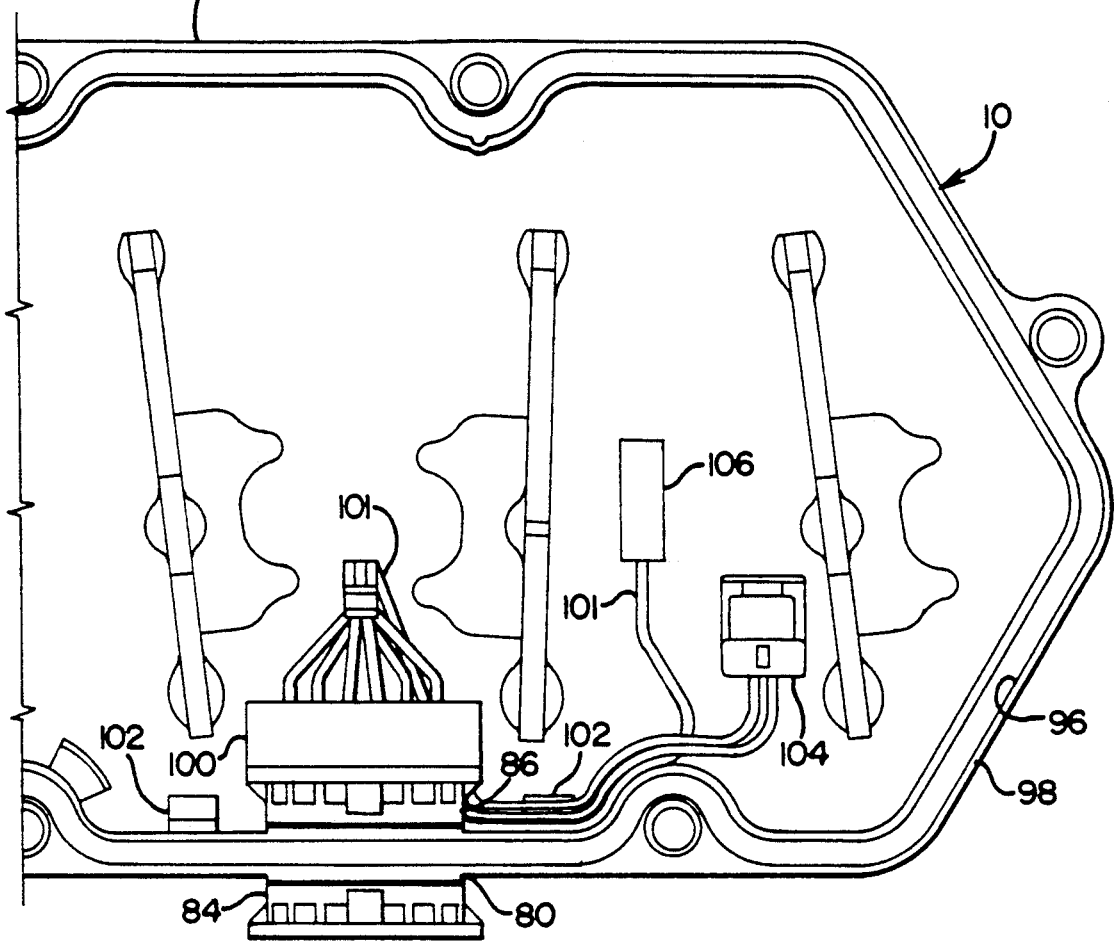
FIG. 10 is a plan view of a portion of a cylinder head having the gasket assembly of FIG. 9 mounted thereon prior to installation of the valve cover.

With these considerations in mind, in the preferred embodiment of the invention illustrated in FIGS. 9 and 10, the gasket 10 includes two bridges 80 (one being shown), each being integrally molded with the gasket body 12 and having a plurality of conductors 82 molded therewithin, each conductor 82 extending between an integrally molded male multiple circuit cable connector 84 exterior of the engine valve cover 27 disposed on the cylinder head 28 to an integrally molded male multiple circuit cable connector 86 inside the valve cover 27. The surface of the electrical bridge 80 further includes a positioning means for engaging the adjacent engine structure to locate the gasket 10 between the cylinder head 28 and valve cover 27 which here takes the form of spaced depending walls 88 and 90 which form an inverted U-shaped slot 92 in bridge 80 in which an upper flange portion 94 of cylinder head 28 is loosely received, sufficient clearance being allowed between the slot 92 and flange portion 94 for manufacturing tolerances. Alternatively, the slot 92 could be disposed to engage the valve cover if desired.

It will be understood that the gasket body 12 of the gasket assembly 10 will be rather stiff due to the thickness of the gasket body and a need to limit flexibility in the areas incorporating the electrical bridges 80 to permit assembly of the electrical connectors. Accordingly, to enhance the sealing of the gasket, shallow U-shaped grooves 96 are formed in the top of the gasket body 12 and in the bottom of the body 12 within the slot 92. Within the grooves 96, which extend around the entire gasket body 12, elastomeric sealing beads 98 are bonded, the sealing beads being of a soft material, such as silicone rubber, having a greater thickness than the depth of grooves 96 to provide a compression seal when the valve cover is bolted down to the cylinder head.

Within the valve cover 27, a female multiple pin connector 100 may be connected to the male connector 86, the female connector having electrical leads 101 attached thereto extending through a clip 102 integrally molded in the gasket body to connectors 104, 106 for the injector and glow plug of the end cylinder of the engine. Similar leads (partially shown) will extend from connector 100 to the adjacent cylinder.

Figure 11:
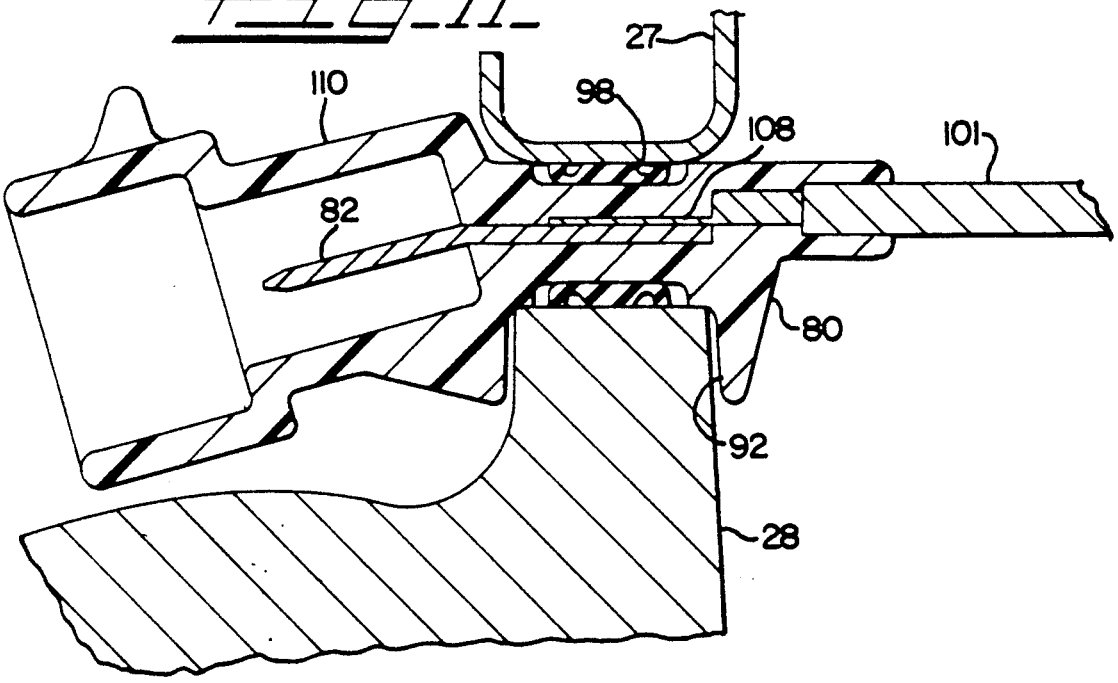
FIG. 11 is sectional view similar to FIG. 9 but illustrating yet a further embodiment of the invention.

The embodiment of FIG. 11 may be considered to be identical to that of FIGS. 9 and 10 except that in this embodiment the electrical leads 101 within the valve cover are permanently connected to the conductors 82 as at 108 and integrally molded therewith in the bridge 80 of the gasket body while the exterior male multiple pin connector 110 has a slightly different configuration and is angled slightly.

Although the various embodiments of the valve cover gasket assembly with an electrical bridge are described in connection with a diesel engine, it is to be understood that the concepts disclosed herein are applicable to gasoline engines as well, for example, to optimize electronic injector placement under the engine valve cover. The gasket assembly with an electrical bridge has a number of advantages, some of which have been described and others of which are inherent in the invention. Also, it is apparent that modifications may be made to the invention without departing from the teachings thereof. For example, the only limitation on positioning of the electrical bridge 19 along the gasket periphery is that it not come into contact with the bolts for securing the valve cover to the cylinder head. Accordingly, the invention is only to be limited as necessitated by the accompanying claims.

We claim:

1. An engine valve cover gasket assembly, for use between a valve cover and a cylinder head of an engine, comprising a planar gasket body having an inner peripheral edge defining a closed periphery having electrically isolated electrical conductor means incorporated therein, electrically insulated first connection means disposed within said closed periphery operatively associated with said conductor means for establishing electrical connection thereof with an electrical device disposed within the valve cover, and electrically insulated second connection means for establishing electrical connection of said conductor means with an electrical control circuit for said device external an electrical control circuit for said device external of the valve cover.

2. An engine valve cover gasket assembly, for use between a valve cover and a cylinder head of an engine, comprising a planar gasket body made of a molded nonconductive plastic material having electrically isolated electrical conductor means incorporated therein and means operatively associated with said conductor means for establishing electrical connection thereof respectively with an electrical device disposed within the valve cover and with an electrical control circuit for said device external of the valve cover.

3. The gasket assembly of claim 2 wherein said conductor means comprises a plurality of conductors integrally incorporated in said gasket.

4. The gasket assembly of claim 3 wherein said electrical connection means comprises at least one multiple circuit electrical connector disposed externally of said valve cover, each of said conductors being connected to a circuit of said connector.

5. The gasket assembly of claim 4 wherein said electrical connector is molded into the gasket assembly during molding of the gasket body.

6. The gasket assembly of claim 4 wherein said electrical connector comprises a male type connector.

7. The gasket assembly of claim 4 wherein said gasket body has a peripheral portion adjacent said conductors defining positioning means engageable with an engine structure for locating the position of said gasket between said valve cover and said cylinder head.

8. The gasket assembly of claim 7 wherein said positioning means comprises a slot molded into the lower surface of said gasket body, said slot receiving therewithin a portion of said cylinder head.

9. The gasket assembly of claim 2 wherein at least one opening extending completely through the gasket body is formed therein, and a wire inserted through said opening.

10. The gasket assembly of claim 1 wherein said gasket body comprises a plastic carrier mechanically interlocked with said gasket body and said conductor means comprises wires molded into the plastic carrier.

11. The gasket assembly of claim 10 wherein said plastic carrier includes spacers for spacing the wires from one another.

12. The gasket assembly of claim 10 wherein said plastic carrier includes a penetrable membrane molded therein and disposed in a plane perpendicular to said conductors for penetration thereby, said carrier having transverse access apertures therein between said membrane and interior and exterior edges of said carrier.

13. The gasket assembly of claim 2 including a pocket disposed in said plastic gasket body, said pocket including means for mechanically guiding wiring therethrough, said pocket being filled with a vulcanizing compound to bond and seal said wiring to said gasket within said pocket.

14. The gasket assembly of claim 13 wherein said mechanical guiding means comprises spacers for spacing the wires from one another.

15. The gasket assembly of claim 14 wherein said spacers comprise parallel grooves formed in a surface of said pocket within which wires are contained.

16. The gasket assembly of claim 2 wherein said plastic gasket body includes a penetrable membrane molded therein and disposed in a plane perpendicular to said conductors for penetration thereby, said body having transverse access apertures therein between said membrane and interior and exterior edges of said carrier.

17. In an engine valve cover gasket of the type used in an internal combustion engine to seal the interface between an engine valve cover and an engine cylinder head, said engine having a plurality of electrically controlled components disposed in said cylinder head within the confines of said valve cover and electrical control means disposed externally of said valve cover for controlling said components, the improvement comprising an electrical bridge integrally molded into said gasket and extending transversely thereacross, said electrical bridge including a plurality of electrically isolated conductors disposed within said gasket, an insulated interior electrical connection means for electrically connecting said conductors respectively with said components, and an insulated exterior electrical connection means for connecting said conductors respectively with said control means.

18. The invention in accordance with claim 17 wherein said exterior means comprises at least one multiple circuit electrical connector integrally molded with said gasket, each of said conductors being connected to a circuit of said exterior connector.

19. The invention in accordance with claim 18 wherein said interior means comprises at least one multiple circuit electrical connector integrally molded with said gasket, each of said conductors being connected to a circuit of said interior connector.

20. The invention in accordance with claim 18 wherein said interior means comprises a plurality of electrical leads integrally molded with said gasket, each of said conductors being connected respectively to one of said leads.

21. The invention in accordance with claim 17 and a positioning means disposed on a surface of said gasket adjacent said conductors, said positioning means being engageable with an engine structure for locating the position of said gasket between said valve cover and said cylinder head.

22. The invention in accordance with claim 21 wherein said positioning means comprises a slot molded into a lower surface of said gasket, said slot receiving therewithin a portion of said cylinder head.

23. The invention in accordance with claim 17 and a shallow groove disposed in a surface of said gasket interfacing with an engine structure and a sealing bead disposed in said groove and establishing an oil tight seal between said gasket and said engine structure.

24. The invention in accordance with claim 17 and a pair of shallow groove disposed in .surfaces of said gasket interfacing respectively with said valve cover and with said cylinder head and sealing beads disposed in each of said grooves to establish an oil tight seal respectively between said gasket and said valve cover and between said gasket and said cylinder head.

25. The invention in accordance with claim 17 and a wire retaining clip integrally molded with said gasket and disposed within said valve cover on a nonsealing surface thereof.

26. The invention in accordance with claim 17 wherein said electrical bridge is U-shaped in cross section.

27. The invention in accordance with claim 17 wherein said electrical bridge is L-shaped in cross section.

* * * * *